US007992708B2

(12) United States Patent
Hein et al.

(10) Patent No.: US 7,992,708 B2
(45) Date of Patent: Aug. 9, 2011

(54) FLIP-TOP PACKET FOR CIGARETTES

(75) Inventors: Viktor Hein, Luttum (DE); Henry Buse, Visselhovede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 12/304,873

(22) PCT Filed: Apr. 28, 2007

(86) PCT No.: PCT/EP2007/003783
§ 371 (c)(1),
(2), (4) Date: Dec. 15, 2008

(87) PCT Pub. No.: WO2007/144043
PCT Pub. Date: Dec. 21, 2007

(65) Prior Publication Data

US 2009/0205982 A1 Aug. 20, 2009

(30) Foreign Application Priority Data

Jun. 15, 2006 (DE) ..... 10 2006 028 130

(51) Int. Cl.
*B65D 85/10* (2006.01)

(52) U.S. Cl. ..... 206/249; 206/251; 206/271

(58) Field of Classification Search ..... 206/250, 206/268, 270, 264, 273, 242, 271, 254, 100, 206/236, 485, 578, 249, 251; 229/160.1, 229/129.1, 125.08; 220/628, 711, 359.3, 220/835
See application file for complete search history.

(56) References Cited

U.S. PATENT DOCUMENTS

| | | | | |
|---|---|---|---|---|
| 439,993 | A | | 11/1890 | Bailey |
| 2,597,810 | A | | 5/1952 | Myers |
| 3,102,675 | A | * | 9/1963 | Schrom ..... 206/251 |
| 3,311,283 | A | * | 3/1967 | Shimada et al. ..... 229/125.08 |
| 3,858,788 | A | | 1/1975 | Phillips, Jr. |
| 3,899,125 | A | * | 8/1975 | Andrews et al. ..... 220/495.01 |
| 3,933,299 | A | | 1/1976 | Shimada et al. |
| 4,049,117 | A | * | 9/1977 | Grimm ..... 206/270 |
| 4,240,548 | A | | 12/1980 | Stio |
| 4,300,676 | A | * | 11/1981 | Focke et al. ..... 206/264 |
| 4,588,081 | A | * | 5/1986 | Newsome et al. ..... 206/251 |

(Continued)

FOREIGN PATENT DOCUMENTS

CH 406 968 A 1/1966

(Continued)

OTHER PUBLICATIONS

Russian Office Action.

*Primary Examiner* — J. Gregory Pickett
*Assistant Examiner* — Raven Collins
(74) *Attorney, Agent, or Firm* — Sughrue Mion, PLLC

(57) ABSTRACT

A cigarette pack of the hinge-lid-box type comprises an outer pack (13) and an inner pack which can be displaced in the longitudinal direction within the outer pack (13). A hinge lid (36) is fitted on one side of the outer pack (13). This hinge lid is moved into an open position by displacement of the inner pack (12) relative to the outer pack (13), to be precise by an opening force being transmitted by means of a pushing-action tab (27) arranged within the pack.

17 Claims, 6 Drawing Sheets

U.S. PATENT DOCUMENTS

| | | | | |
|---|---|---|---|---|
| 4,646,960 | A * | 3/1987 | Challand | 206/259 |
| 4,887,711 | A * | 12/1989 | Bladt | 206/92 |
| 6,691,869 | B2 * | 2/2004 | Knaack et al. | 206/446 |
| 2005/0252796 | A1 * | 11/2005 | Sendo | 206/261 |

FOREIGN PATENT DOCUMENTS

| | | | |
|---|---|---|---|
| CH | 406968 | A | 1/1966 |
| CH | 598 061 | A5 | 4/1978 |
| DE | 12 85 948 | B | 12/1968 |

* cited by examiner

FLIP-TOP PACKET FOR CIGARETTES

The invention relates to a pack with a hinge lid for articles, in particular for a cigarette group, having an inner part or an inner pack and an outer part or outer pack which at least partially encloses the inner part or inner pack and in which the inner pack can be displaced, the outer pack and inner pack being connected to one another via an actuating means for pivoting the hinge lid by relative displacement between the outer pack and inner pack.

Such a pack is known from DE 12 85 948. The pack comprises two sub-packs, namely a sleeve-like outer pack and a slide-like inner pack. A hinge lid is arranged on the inner pack and connected to the outer pack via an actuating tab. When the inner pack is displaced within the outer pack, the actuating tab transmits tensile force to the lid, as a result of which the latter is pivoted into an open position. The actuating tab is arranged in the region of a rear wall of the lid and is connected to a top end wall of the same. This known hinge-lid pack with an automatic opening mechanism for the hinge lid is complex in construction and laborious to handle. It is also the case that the external appearance of the pack is unsatisfactory.

The object of the invention is to propose a pack which has a hinge lid actuable via a pack part and which ensures straightforward industrial manufacturing, is easy to handle by the user and has an advantageous external appearance.

In order to achieve this object, the pack according to the invention is characterized in that the actuating means, in particular an actuating tab, by means of transmitting pressure, moves the hinge lid into an open position.

Accordingly, in the case of the pack according to the invention, the inner pack is connected to the outer pack via a pressure-exerting tab. The hinge lid, upon actuation, namely displacement of the inner pack, is moved into the open position as a result of pressure acting on the inside of the hinge lid.

Also important is the fact that, in the case of the pack according to the invention, the hinge lid is fitted on the outer pack. The pressure-exerting tab, as actuating means for the hinge lid, is connected, on the one hand, to the inner pack and, on the other hand, to the inside of the hinge lid, in particular to a lid rear wall. Accordingly, the actuating means is arranged exclusively within the pack and is not visible from the outside. Furthermore, fitting the lid on the outer pack is advantageous for the external appearance.

The actuating tab is formed in a particular manner for the purpose of transmitting the compressive force, that is to say it comprises two pressure-exerting legs which are connected to one another via (linear) articulations and are connected on the one hand to the inner pack and on the other hand, via a connecting component, to the hinge lid. The tab in its entirety forms part of the blank of the inner pack.

According to a special development, the pack has two mutually opposite hinge lids which can be moved in particular jointly and (approximately) simultaneously into an open position by the inner pack, with the result that the cigarette group is free on two mutually opposite sides.

Further special features relate to the design of the blanks, measures for ensuring correct opening and closing movement of the hinge lid and measures to facilitate handling.

Exemplary embodiments of the pack according to the invention and of the blanks will be explained in more detail hereinbelow with reference to the drawings, in which.

Figure 1:
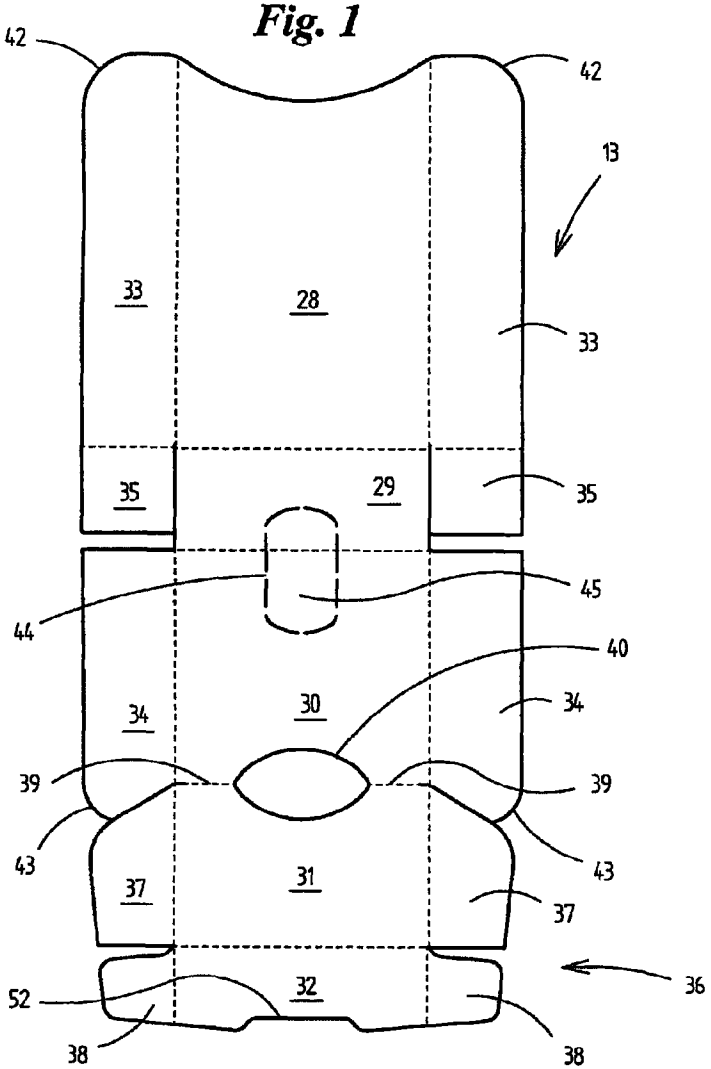
FIG. 1 shows a spread-out, non-folded blank for an outer pack.
Figure 4:
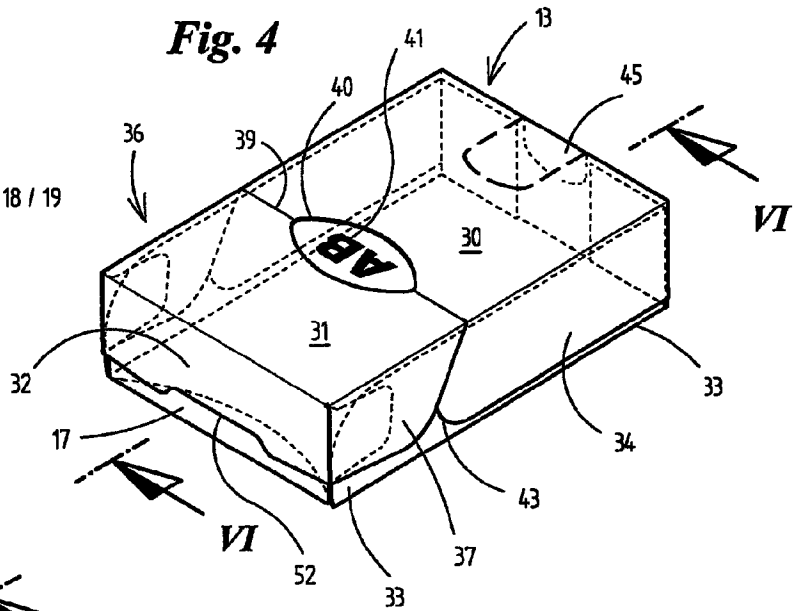
Figure 3:
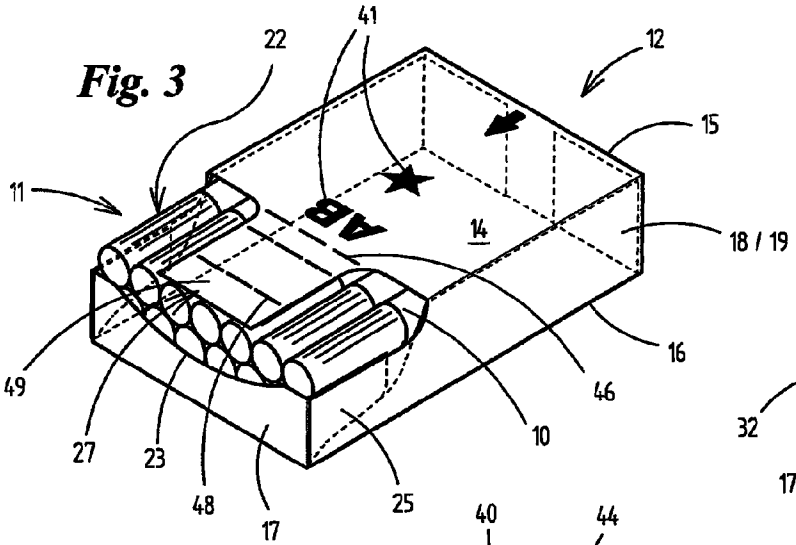
Figure 5:
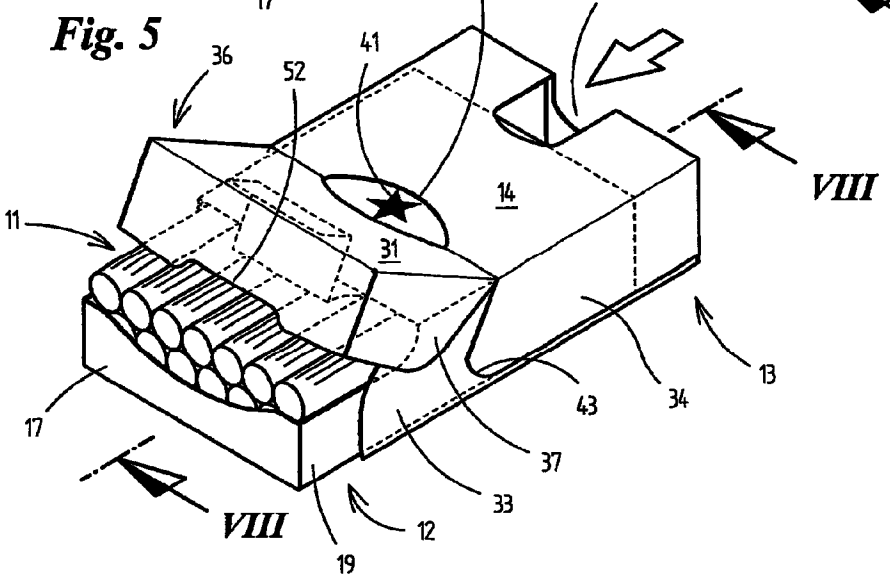
Figure 6:
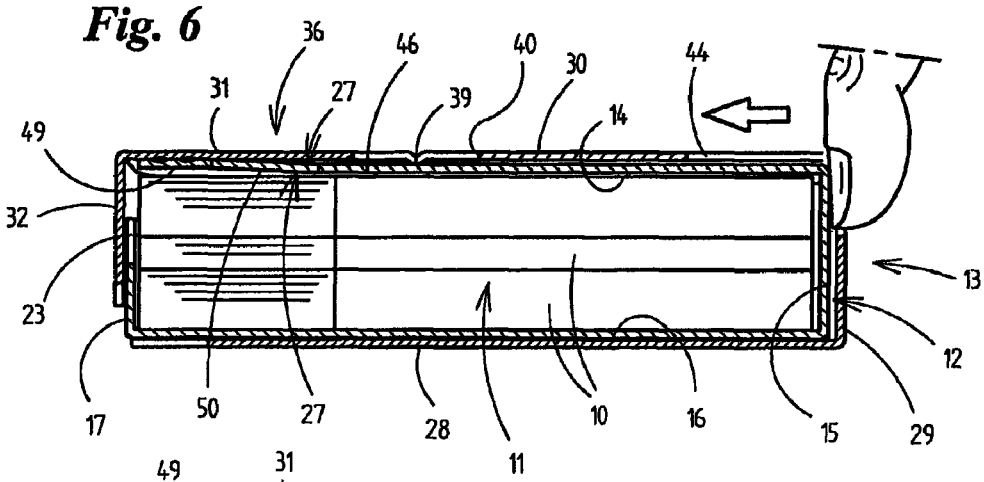
Figure 7:
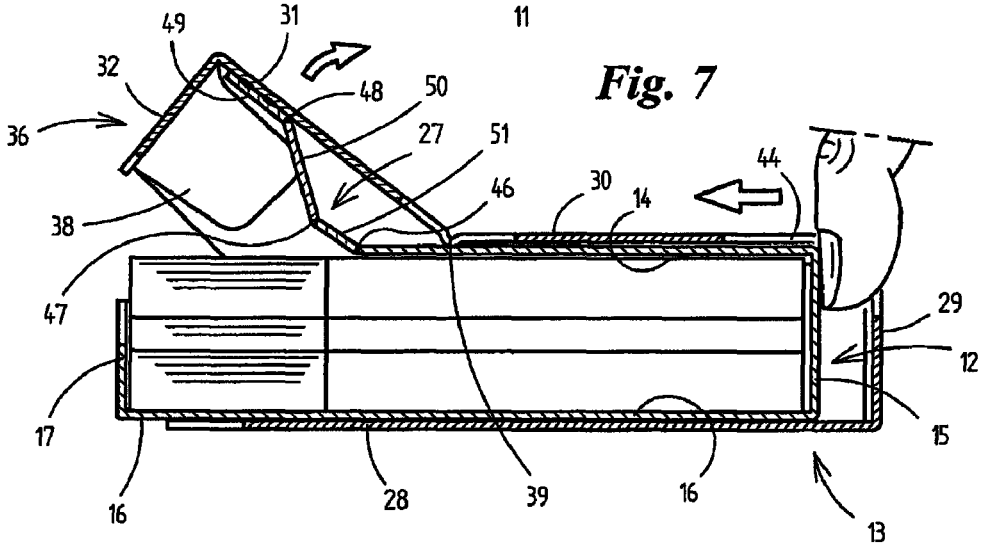
Figure 8:
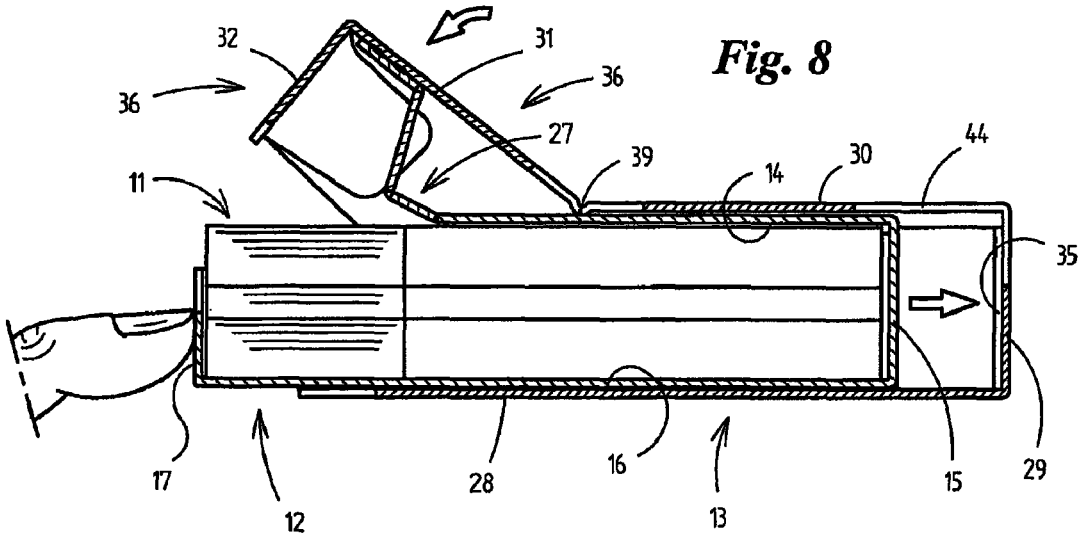
Figure 10:
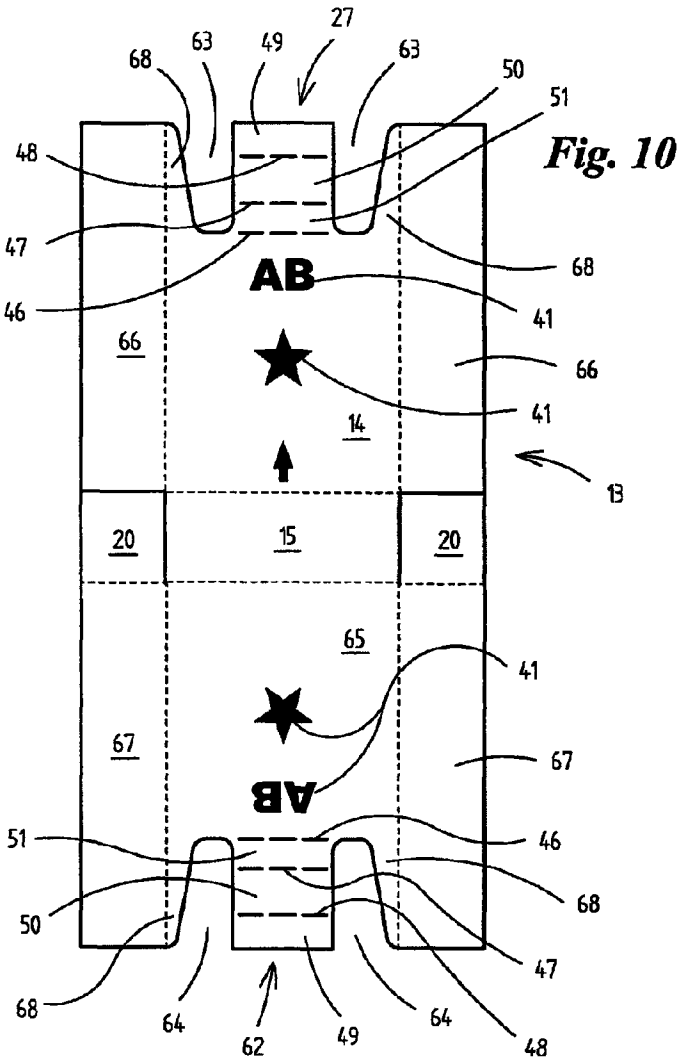
Figure 9:
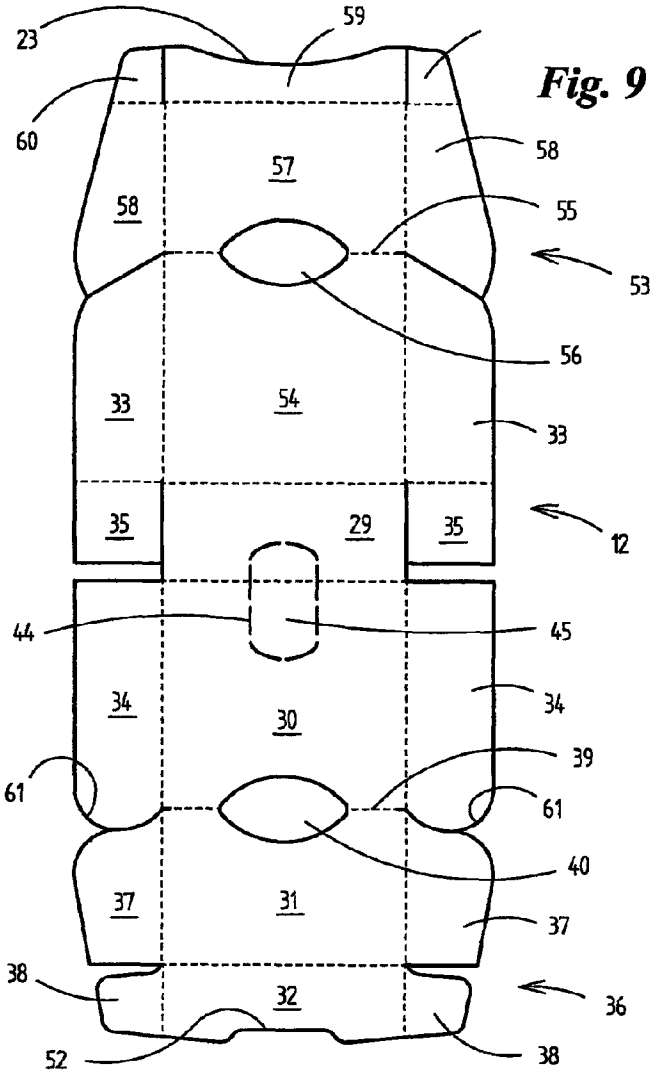
Figure 12:
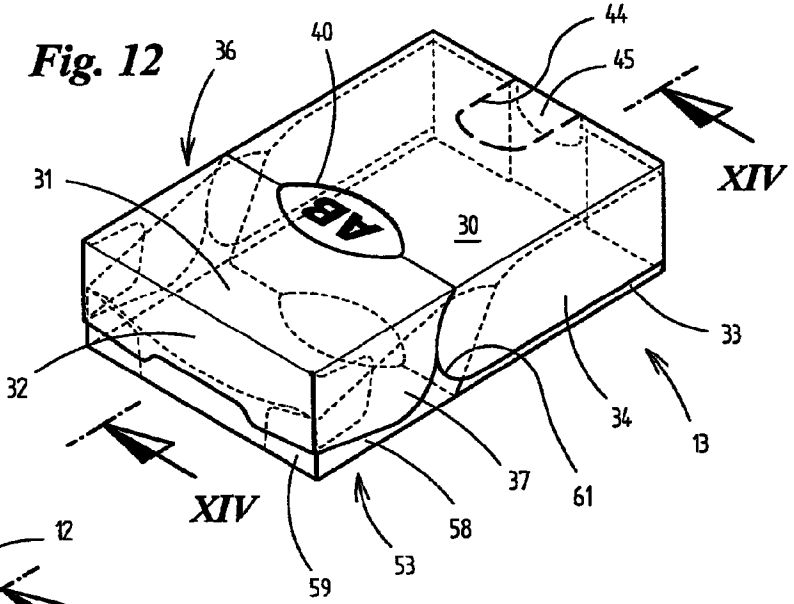
Figure 11:
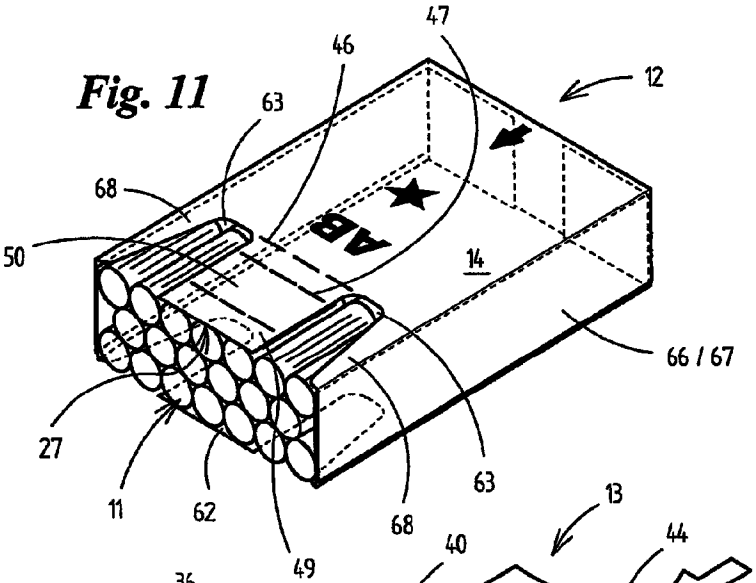
Figure 13:
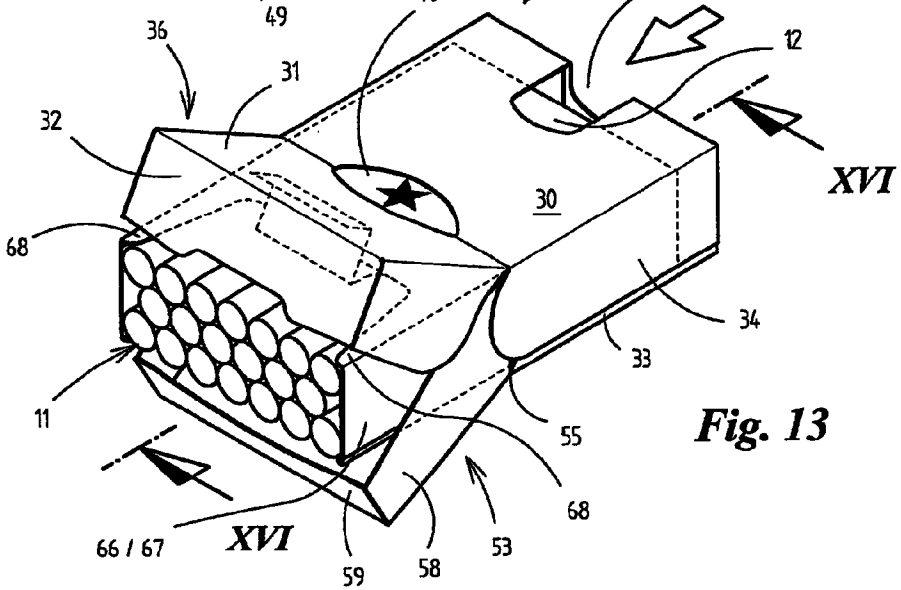
Figure 14:
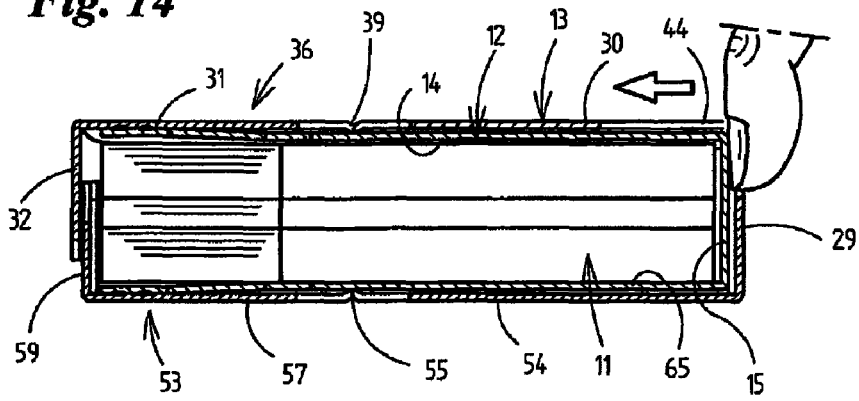
Figure 15:
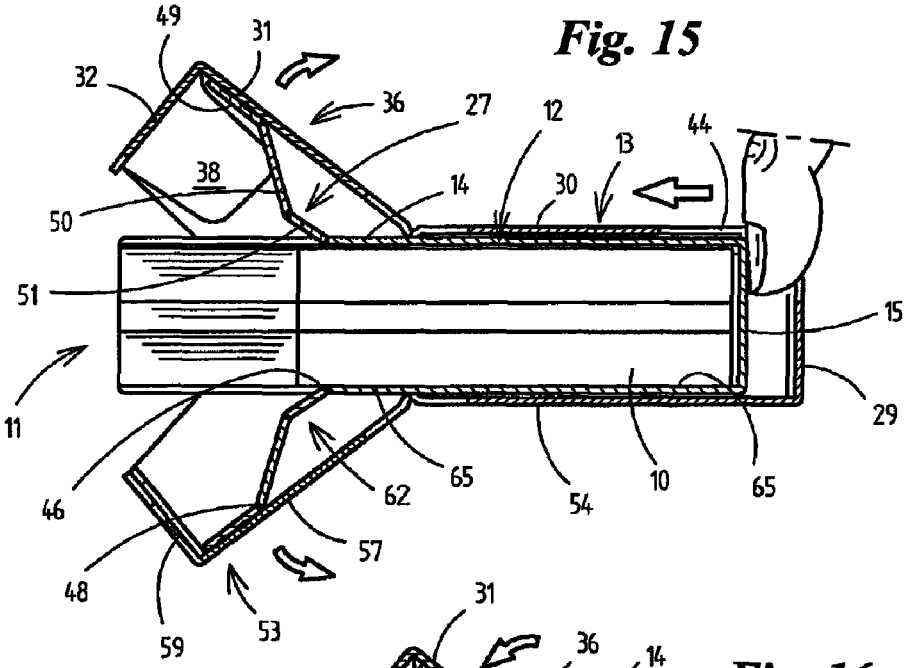
Figure 16:
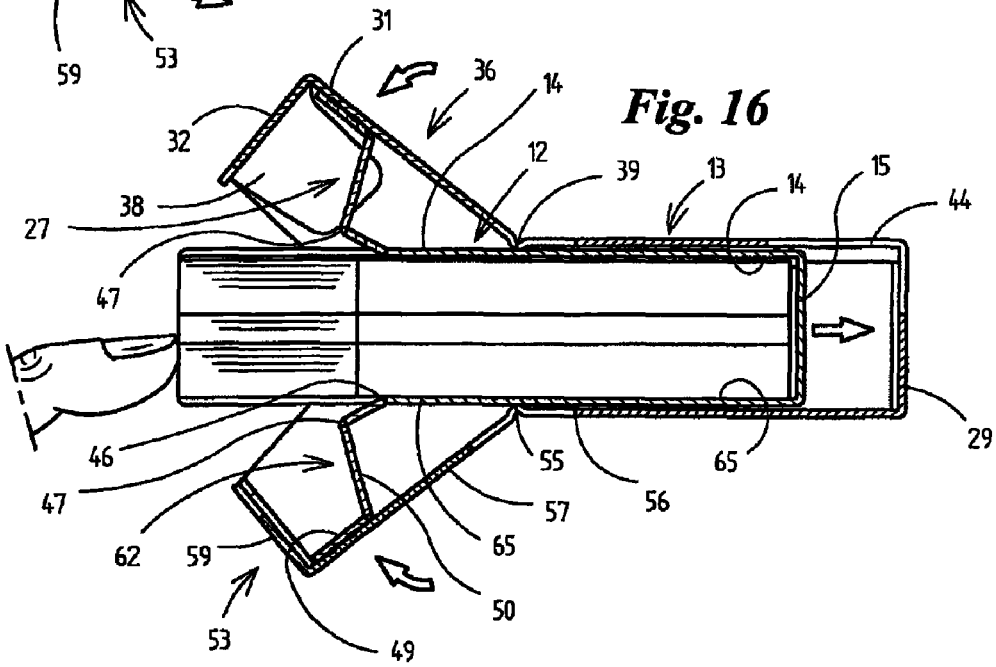

FIG. 3 shows a perspective illustration of the inner pack in the finished state with a cigarette group, FIG. 4 shows an illustration, likewise in perspective, of the completed pack comprising inner pack and outer pack, FIG. 5 shows a perspective illustration of the pack according to FIG. 4 in the open position of a hinge lid, FIG. 6 shows, on an enlarged scale, the closed pack according to FIG. 4 in longitudinal section along section plane VI-VI from FIG. 4, FIG. 7 shows the pack in an illustration corresponding to FIG. 6 during the opening operation, FIG. 8 shows the pack in an illustration corresponding to FIG. 6 with the hinge lid open, namely in the form of longitudinal section VIII-VIII from FIG. 5, FIG. 9 shows a blank for an outer pack analogous to FIG. 1 for a different exemplary embodiment of a pack, FIG. 10 shows a blank for an inner pack corresponding to FIG. 9, FIG. 11 shows a perspective illustration of an inner pack in the finished state with a cigarette group and made of a blank according to FIG. 10, FIG. 12 shows a perspective illustration of the completed pack made of blanks according to FIGS. 9 and 10, FIG. 13 shows the pack according to FIG. 12 with the hinge lids open, FIG. 14 shows, on an enlarged scale, the pack according to FIG. 12 in longitudinal section along section plane XIV-XIV from FIG. 12, FIG. 15 shows the pack in an illustration according to FIG. 14 during the opening operation, and FIG. 16 shows the pack in the open position corresponding to FIG. 13 as seen in longitudinal section XVI-XVI from FIG. 13.

The exemplary embodiments which are illustrated in the drawings relate to the packaging of cigarettes 10 in a particular formation as a cigarette group 11. The packs are also suitable for other pack contents in the form of individual items.

The pack is in the form of a hinge-lid box or hinge-lid pack. It comprises two blanks, from which can be produced, on the one hand, an inner pack 12 (FIG. 2) and, on the other hand, an outer pack 13 (blank according to FIG. 1). The cigarette group 11 is seated in the inner pack 12. The blank (FIG. 2) is formed such that the inner pack 12 can be produced on a standard packaging machine for hinge-lid boxes.

In the case of the exemplary embodiment according to FIGS. 1 to 8, the cigarette group 11 is largely enclosed by the blank of the inner pack 12 (FIG. 3). The blank is constructed such that the inner front wall 14, inner base wall 15 and inner rear wall 16 form successive regions within the elongate (inner) blank. The inner rear wall 16 is followed by an inner end wall 17.

Side flaps, namely outer flaps 18, are arranged on both sides of the inner front wall 14. Correspondingly, inner side flaps, namely inner flaps 19, are fitted on both sides of the inner rear wall 16. Level with the inner base wall 15, base corner flaps 20 are arranged on the side flaps or inner flaps 19. When the inner pack 12 is in the finished state, the corner flaps 20 are preferably connected to the inner base wall 15 by adhesive bonding.

Figure 2:
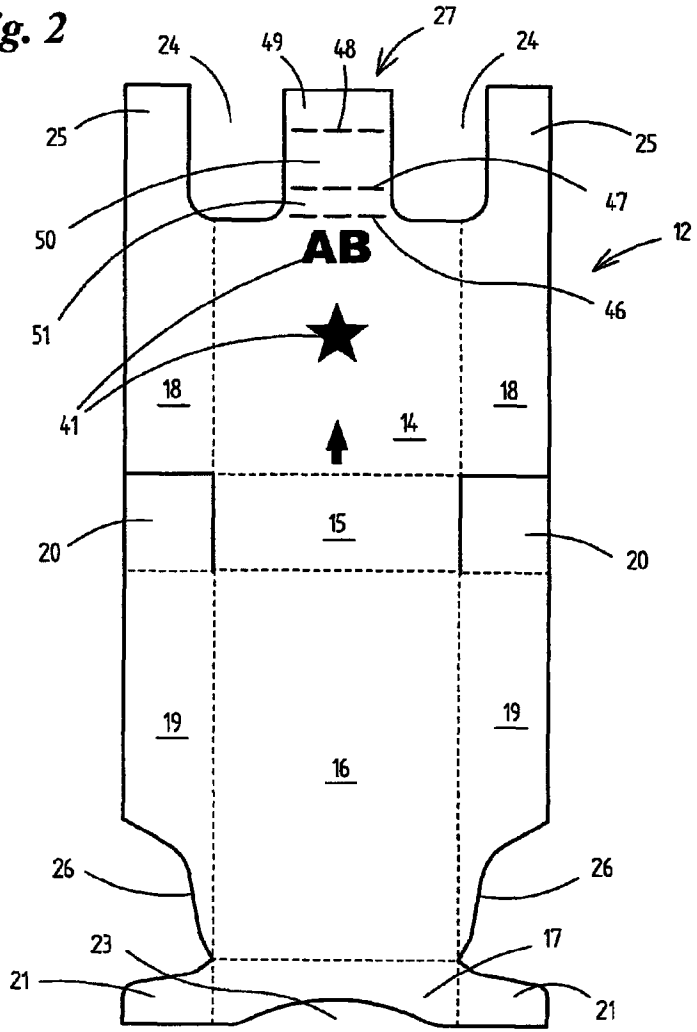
FIG. 2 shows a corresponding illustration of a blank for an inner pack.

The folded inner blank according to FIG. 2 gives an inner pack 12 in which mutually opposite side walls are formed by the overlapping outer flaps 18 and inner flaps 19, which are connected to one another, in particular, by adhesive bonding. The inner pack 12 is essentially in box form with an end-side opening region. For this purpose, the end flap 21 is erected into a position in which it is transverse to the inner rear wall 16. Arranged on both sides of the inner end wall 17 are end flaps 21 which are connected to the inner end wall and, in the folding position (FIG. 3), butt against the inside of the outer flaps 18 and are connected to the latter preferably by adhesive bonding. The inner end wall 17 extends merely over a sub-region of the height and/or depth of the inner pack 12 such that at least one front cigarette row 22 of the cigarette group 11 is exposed (FIG. 3). Furthermore, the inner end wall 17 is provided with a depression 23 which facilitates access to the ends of the cigarettes 10 in the inner pack 12.

The inner front wall 14 is configured in a particular manner with the outer flaps 18. Cutouts 24 are formed in an end region. These cutouts are essentially rectangular with rounded corner regions and are open in the direction of the free periphery of the blank. The two cutouts 24 extend in the region of the inner front wall 14 and in each case in adjacent regions of the outer flaps 18. These therefore form end strips 25 as parts of the outer flaps 18, albeit with a lesser width and/or height than the latter. The side walls of the inner pack 12, which are formed by the flaps 18, 19, are thus provided, in an end region, with a cutout which continues in the front side, namely in the region of the inner front wall 14. It is thus easy to grip the cigarettes 10. The inner flaps 19 have a curved edge 26 at the end, and this forms a cutout. When the inner pack 12 is in the finished state, the correspondingly formed end flaps 21 enter into this cutout (FIG. 3). Accordingly, in this region, the side walls are likewise formed only in two layers.

The inner blank is preferably provided, in the center in relation to the inner front wall 14, with a tongue-like protrusion which is bounded by the cutouts 24. This protrusion is an actuating means, namely a pushing-action tab 27 of particular importance.

The outer pack 13 comprises the outer blank according to FIG. 1. Here too, in the case of an elongate blank, successive regions are defined for an outer rear wall 28, an outer base wall 29, an outer front wall 30, a lid front wall 31 and a lid end wall 32. The last-mentioned folding flaps 31 and 32 of the blank form a hinge lid 36 of the outer pack 13.

In order to form narrow, elongate side walls of the outer pack 13, inner side flaps 33 are fitted on the outer rear wall 28 and outer side flaps 34 are fitted on the outer front wall 30. Corner flaps 35 are located in extension of the inner side flaps 33 and, when the outer pack 13 is in the finished state, these corner flaps butt against the base wall 29 and are connected thereto preferably by adhesive bonding. The side walls are formed by the overlapping side flaps 33 and 34, which are likewise preferably connected to one another.

In order to form the pivotable lid or hinge lid 36 on the outer pack 13, lid side flaps 37 are fitted laterally on the lid front wall 31. Lid corner flaps 38 are located on both sides of the lid end wall 32. With the lid end wall 32 erected, these lid corner flaps butt against the inside of the lid side flaps 37 and are preferably connected to the latter by adhesive bonding. Accordingly, the hinge lid 36 is formed such that lid walls are produced on the front side, end side and on the narrow sides of the pack. The side walls of the hinge lid 36 are formed predominantly in a single layer by the corresponding lid side flaps 37.

The hinge lid 36 and/or the lid front wall 31 is delimited from the rest of the (box part of the) outer pack 13, to be precise from the outer front wall 30, by a transversely directed articulation, namely by a linear articulation 39. In order to facilitate pivoting of the hinge lid 36, this linear articulation is formed so as to provide, on the one hand, a durable connection but also, on the other hand, pivoting capability with low opposing forces. For this purpose, the blank according to FIG. 1 or the outer pack 13 has a punched portion in the region of the linear articulation 39. This is a central opening 40 which extends on both sides of the linear articulation 39 and, in this case, is oval. On the one hand, the opening 40 reduces the force of resistance in the region of the articulation 39. On the other hand, it prevents curvature from arising in the region of the outer front wall 30 and of the lid front wall 31 when the hinge lid 36 is opened. The inner pack 12, in the region of the opening 40 (when the pack is closed), is provided with informative or decorative printing 41 on the inner front wall 14.

Particular regions or folding flaps of the outer pack 13 are provided with rounded portions. End edges 42 of the inner side flaps 33 are formed with pronounced rounded portions, which can be seen as free edges when the lid is open (FIG. 5). Furthermore, the outer side flaps 34 are provided with rounding edges 43 on the side which is directed toward the hinge lid 36.

The completed (cigarette) pack comprises the outer pack 13 and the inner pack 12 arranged therein. The procedure is expediently such that, in the first instance, the inner pack 12 together with pack contents is produced and, thereafter, the blank of the outer pack 13 is folded around the inner pack 12. The inner pack 12 can be displaced in the longitudinal direction within the outer pack 13. For this purpose, it is possible for the outer base wall 29 to be done away with altogether or to have a cutout for (manual) access to the inner pack 12 and/or to the inner base wall 15 thereof. Here, a cutout 44 is provided in the outer pack 13, this cutout extending in the region of the base wall 29 and then in the region of the outer front wall 30. The cutout 44 is created when the pack is opened for the first time. For this purpose, a piece of material 45 is defined by weakening lines, namely by perforation lines, in the base wall 29 and the front wall 30 (FIG. 1). The tab or the piece of material 45 is removed by hand. This creates the cutout 44. The latter makes it possible for a pushing force to be transmitted to the inner pack 12, namely, in particular, to the inner base wall 15.

Displacement of the inner pack 12 in the direction of the hinge lid 36 opens the latter automatically, to be precise by way of an inner pushing means, the latter being the pushing-action tab 27. This is arranged, and formed, such that the hinge lid 36 is pivoted into an open position (FIG. 5) as a result of the relative movement.

The transmission of the pushing force to the hinge lid 36 is ensured, in particular, by a special arrangement and configuration of lines of inflection of the pushing-action tab 27. The latter has three parallel, transversely directed linear articulations 46, 47, 48. The abovementioned articulations 46 . . . 48 are defined by material weakenings, namely by stamped sections in the material and/or by punch cuts. These define a plurality of portions of the pushing-action tab 27. An end piece 49 is connected to the inside of the hinge lid 36, to be precise to the front wall 31 of the lid, expediently by adhesive bonding. During production, an adhesive may be applied to the associated region of the lid front wall 31 and/or to the end piece 49, this resulting in a connection when the pack is completed (FIG. 6).

A longitudinally larger leg 50, which adjoins the end piece 49, transmits the pushing force to the lid 36. In order for the lid 36 to be reliably lifted out of the closed position, the linear articulation 47 is formed to be weaker than the linear articulation 46, for delimiting a shorter peripheral leg 51. Configuring the linear articulations 46 and 47 differently, namely with the weaker articulation line 47, ensures that, upon initiation of the opening movement for the hinge lid 36, the larger leg 50 is erected reliably and transmits the opening force. The different forces of resistance in the region of the linear articulations 46 and 47 are produced by the number of punched portions and/or the length of the residual connections of the material. The linear articulation 46 has more, or longer, residual connections.

A further important factor for the opening operation to proceed is the fact that the pushing-action tab 27 is placed in a certain position relative to the linear articulation 39 of the hinge lid 36. In particular, it is expedient and/or necessary to have, between the linear articulation 39 and the first or adjacent linear articulation 46 of the pushing-action tab 27, a reasonable distance in the direction of the hinge lid 36, as is shown in FIG. 6.

Upon closure of the pack (FIG. 8), pressure is exerted on the end side of the pack, namely on the end wall 17 of the inner pack 12. The latter is pushed back into the starting position according to FIG. 6, in which the base walls 15 and 29 butt against one another. During this return movement, the lid 36 is subjected to a tensile force. The pushing-action tab 27 returns gradually into the straightened-out position. This results in a closing movement of the hinge lid 36. The lid end wall 32 is provided centrally with a depression 52 which makes it possible for the compressive force to be transmitted to the end wall 17 of the inner pack 12 even in the end phase of the closing movement of the hinge lid 36.

A development of, and modification to, the hinge-lid pack described is shown in FIGS. 9 to 16. This alternative is likewise provided with an inner pack 12 and outer pack 13. The latter has a hinge lid 36 analogous to the hinge lid of the exemplary embodiment described. A further hinge lid, namely an inner lid 53, is fitted on the outer pack 13, to be precise on a pack rear side, adjacent to and/or opposite the hinge lid 36. In respect of dimensions and configuration, the hinge lids 36, 53 are coordinated with one another such that, when the pack is closed, certain sub-regions of the rear-side inner lid 53 are enclosed by the (larger) hinge lid 36 (FIG. 12).

The configuration with two hinge lids 36, 53 requires the blanks to be formed correspondingly. The outer blank according to FIG. 9 has, in a central region (in relation to the longitudinal extent), folding flaps for the (bottom) box part of the pack and, at both end regions, folding flaps for the hinge lid 36, on the one hand, and the hinge lid 53, on the other hand. An outer front wall 30, the following outer base wall 29 and the folding flaps 31, 32 of the hinge lid 36 are formed in the same way as in the case of the exemplary embodiment of FIG. 1. The rear side of the outer pack 13 comprises an outer rear wall 54, to which folding flaps or the inner lid 53 are/is connected via a transversely directed folding line, namely via a linear articulation 55. For the reasons outlined, an opening 56 corresponding to the opening 40 is provided in the region of this linear articulation 55. A lid rear wall 57, which is connected to the rear wall 54, has, on both sides, lid side flaps 58 which are more or less trapezoidal, that is to say they converge in the direction of a lid end wall 59. Arranged in extension of the lid side flaps 58 are lid corner flaps 60 which, when the pack is in the finished state, butt against the inside of the lid end wall 59 and are connected to the latter preferably by adhesive bonding. The rear-side inner lid 53 is thus formed as a tray-like sub-pack for the cigarette group 11 (FIG. 13). The hinge lid 36, which is located on the outside when the pack is closed, is formed analogously to the exemplary embodiment according to FIG. 1, that is to say with lid corner flaps 38, which are fitted on both sides of the lid end wall 32.

A special configuration is provided according to FIG. 9 for the (outer) side flaps 34 of the outer pack 13. An end edge 61 of the side flap 34, this end edge being directed toward the hinge lid 36, is rounded, in particular in circular or partially circular form, throughout. The lid side flap 37, which follows in the longitudinal direction of the blank, is adapted in arcuate form—separated by a corresponding punch cut—to the contour of the end edge 61. The mutually facing edges of the folding flaps 34 and 37 are advantageous for the pivoting movements of the hinge lid 36 (FIG. 12/FIG. 13).

The blank for the inner pack 12 of this configuration is formed in a particular way (FIG. 10). In order to actuate each lid, namely the hinge lid 36 and, approximately at the same time, the inner lid 53, use is made of means which are fitted on the inner blank and are intended for transmitting compressive forces to the hinge lids 36, 53 during the opening movement. Each hinge lid is assigned a pushing-action tab, that is to say the front-side hinge lid 36 is assigned the pushing-action tab 27, which has already been described, and the inner lid 53 is assigned a correspondingly formed pushing-action tab 62, which is located opposite. The two pushing-action tabs 27, 62 are formed in the manner described in conjunction with FIG. 2. The movement sequence during opening and closure of the hinge lids 36, 53 (FIGS. 14 to 16) also corresponds to that already described.

The cutouts 63, 64, which are arranged on both sides of the pushing-action tabs and, in this case, correspond to one another, are configured differently to those of the first embodiment. These cutouts bound the rectangular tabs 27, 62. The cutouts 63, 64 are located exclusively in the region of the inner front wall 14 and of an inner rear wall 65, which is formed in a manner corresponding to the inner front wall 14. Outer flaps 66 and inner flaps 67, which are adjacent to the front wall 14, on the one hand, and the rear wall 65, on the other hand, extend over the full width over the entire length of the pack. In the region of the front wall 14 and rear wall 65, the cutouts 63 and 64 are spaced apart in each case from folding edges for bounding the flaps 66, 67, such that material webs 68 are defined in each case in the region of the front wall 14 and rear wall 65. These material webs 68, which in this case narrow in the direction of the free periphery of the blank, improve the fixing action of the cigarettes 10 and/or at the cigarette group 11 in the pack when the hinge lids 36, 53 are open (FIG. 13). Cigarettes along the periphery and/or at the corners are fixed in the opening region by the side wall of the inner pack 12, that is to say by the overlapping flaps 66, 67, and in the region of the adjacent front and rear sides by the material webs 68.

The blank for the inner pack 12, in a manner analogous to the exemplary embodiment above, is provided, in the region of the front wall 14 and rear wall 65, with printing 41, to be precise with two printed sections each positioned relative to the respective openings 40 and 56 such that in the two end positions, namely in the closed position and in the open position, printing 41 is visible toward the outside in the region of the opening 40, 56.

The exemplary embodiments correspond, or are formed analogously, in respect of further design features. The blanks for the inner pack 12 and outer pack 13 preferably consist of the same material, in particular of a cardboard which is customary for hinge-lid boxes. Both configurations can be produced on standard packaging machines for hinge-lid boxes, to be precise in successive operating steps.

Further special features of the abovedescribed packs or hinge-lid boxes may be seen in the fact that the pack contents are largely encased, that is to say protected, by the inner pack 12. Even with the lid slightly open, the pack contents are concealed. Furthermore, the construction and arrangement of the pushing-action tabs 27, 62 ensures that, as a result of the portions of the pressure-exerting tabs being inflected successively, the hinge lids 36, 53 are opened in the first instance with a comparatively high level of force and then quickly.

LIST OF DESIGNATIONS

10 Cigarette
11 Cigarette group
12 Inner pack
13 Outer pack
14 Inner front wall
15 Inner base wall
16 Inner rear wall
17 Inner end wall
18 Outer flap
19 Inner flap
20 Base corner flap
21 End flap
22 Cigarette row
23 Depression
24 Cutout
25 End strip
26 Edge
27 Pushing-action tab
28 Outer rear wall
29 Outer base wall
30 Outer front wall
31 Lid front wall
32 Lid end wall
33 Side flap (inner)
34 Side flap (outer)
35 Corner flap
36 Hinge lid
37 Lid side flap
38 Lid corner flap
39 Linear articulation
40 Opening
41 Printing
42 End edge
43 Rounding edge
44 Cutout
45 Piece of material
46 Linear articulation
47 Linear articulation
48 Linear articulation
49 End piece
50 Leg
51 Peripheral leg
52 Depression
53 Inner lid
54 Outer rear wall
55 Linear articulation
56 Opening
57 Lid rear wall
58 Lid side flap
59 Lid end wall
60 Lid corner flap
61 End edge
62 Pushing-action tab
63 Cutout
64 Cutout
65 Inner rear wall
66 Outer flap
67 Inner flap
68 Material web

The invention claimed is:

1. A pack with at least one hinge lid (36, 53) for a cigarette group (11), having an inner pack (12) and an outer pack (13) which at least partially encloses the inner pack (12) and in which the inner pack (12) can be displaced, the inner pack (12) and outer pack (13) being connected to one another by an actuating means for pivoting the hinge lid (36, 53) by relative displacement between the inner pack (12) and outer pack (13), characterized by the following features:

a) the hinge lid (36, 53) is fitted in a pivotable manner on the outer pack (13), b) a pushing-action tab (27, 62), for pivoting the hinge lid (36, 53), is arranged within the pack as a connecting means between the inner pack (12) and hinge lid (36, 53), c) the pushing-action tab (27, 62), is either connected to an inner front wall (14) of the inner pack (12) and the inside of lid front wall (31) of the hinge lid (36,53)

or to an inner rear wall (65) of the inner pack (12) and the inside of lid rear wall (57) of the hinge lid (36, 52), such that, when the inner pack (12) is pushed within the outer pack (13) in the direction of the open position, a compressive force is transmitted to the inside of the hinge lid (36, 53) by the pushing-action tab (27, 62) for pivoting the hinge lid (36, 53) into an open position, d) the pushing action tab (27, 62) for pivoting the hinge lid (36, 52) on the outer pack (13) can be subjected to compressive loading and comprises tab portions or legs (49, 50, 51) which are delimited from one another by linear articulations (46, 47, 48) which are directed transversely to the pushing movement of the inner pack (12).

2. The pack as claimed in claim 1, characterized in that tab portions or legs (49, 50, 51) are delimited from one another by linear articulations (46, 47, 48), with the linear articulations (46 . . . 48), in order to transmit the pushing force, having different levels of deformation resistance.

3. The pack as claimed in claim 1, characterized in that the different levels of deformation resistance of the linear articulations (46 . . . 48) are created by different perforations.

4. The pack as claimed in claim 1, characterized in that the pushing-action tab (27, 62) is part of the blank of the inner pack (12), in particular on a region of an inner front wall of the inner pack (12) which is directed toward the hinge lid (36, 53), with the pushing-action tab (27, 62) having three parallel, differently spaced-apart linear articulations (46, 47, 48), of which the linear articulation (46), which is directed toward the inner front wall (14), is formed with a relatively higher level of pivoting resistance.

5. The pack as claimed in claim 1, characterized in that an outer, end region of the pushing-action tab (27, 62) is connected to the inside of the hinge lid (36, 53) by adhesive bonding or the like.

6. The pack as claimed in claim 1, characterized in that, in a region which is directed toward the hinge lid (36, 53), the inner pack (12) has cutouts (24, 63, 64) which, on the one hand, bound the pushing-action tab (27, 62) and, on the other hand, form an opening for the removal of cigarettes (10).

7. The pack as claimed in claim 6, characterized in that the cutouts (24) extend into the region of side walls of the inner pack (12) or into the region of overlapping outer flaps (18) and inner flaps (19) such that cigarettes along the periphery or at the corners are exposed.

8. The pack as claimed in claim 1, characterized in that the hinge lid (36, 53) is connected to the outer pack (13) via a transversely directed linear articulation (39, 55), the linear articulation (39, 55) having a continuous interruption in a central region in the form of an opening (40, 56) in the region of adjacent outer walls (30, 54, 31, 57).

9. The pack as claimed in claim 1, characterized in that, in a base region, the outer pack (13) has a cutout (44) for access to the inner pack (12) extending around the corner in the region of the base wall (29) and outer front wall (30) with a detachable piece of material (45).

10. The pack as claimed in claim 1, characterized in that the inner pack (12) largely encloses the pack contents with the exception of the cutouts (24; 63, 64) in the front region and an exposed region of the inner end wall (17), which extends over part of the width or depth of the end side.

11. The pack as claimed in claim 1, characterized in that the outer pack (13), including the hinge lid (36, 53), fully encloses the inner pack (12) in the closed position.

12. The pack as claimed in claim 1, characterized by two lids arranged on opposite sides of the outer pack (13), namely a hinge lid (36), on the one hand, and inner lid (53), on the other hand, the hinge lid (36) being fitted on an outer front wall (30) and the inner lid (53) being fitted on an outer rear wall.

13. The pack as claimed in claim 12, characterized in that the hinge lid (36) and inner lid (53) can be moved approximately simultaneously into the open position by displacement of the inner pack (12) in the outer pack (13) by way of a pushing-action tab (27, 62) assigned to each lid (36, 53).

14. The pack as claimed in claim 12, characterized in that the inner pack (12) or a blank of the same has two mutually opposite pushing-action tabs (27, 62) as part of the inner front wall (14) and of an inner rear wall (65), respectively, the pushing-action tabs (27, 62) being delimited by cutouts (63, 64) exclusively in the region of the inner front wall (14) and inner rear wall (65), respectively.

15. The pack as claimed in claim 14, characterized in that the cutouts (63, 64) are spaced apart in each case from adjacent outer flaps (66) and inner flaps (67), respectively, of the inner pack (12) such that the inner front wall (14) and the inner rear wall (65) form material webs (68) which enclose the pack contents in the region of the front side and rear side.

16. The pack as claimed in claim 1, characterized in that an end wall (32) of the hinge lid (36) or an inner end wall (17) of the inner pack (12), have in each case corner flaps on both sides, namely lid corner flaps (38), on the one hand, and end flaps (21), on the other hand, with the folded lid corner flaps (38) being connected to side parts of the pack or of the hinge lid (36) or the folded end flaps (21) are connected to side walls of the inner pack (12), namely to lid side flaps (37), on the one hand, and to outer flaps (18), on the other hand.

17. The pack as claimed in claim 12, characterized in that, in the case of a configuration with an outer hinge lid (36), on the one hand, and inner lid (53), on the other hand, lid corner flaps (60) assigned to a lid end wall (59) of the inner lid (53) are connected to lid side flaps (58) and butt against the inside of the lid end wall (59) and are connected to the same.

* * * * *